US012071596B2

(12) United States Patent
Zhao et al.

(10) Patent No.: US 12,071,596 B2
(45) **Date of Patent: *Aug. 27, 2024**

(54) METAL WORKING FLUIDS BIOCIDE

(71) Applicant: Dow Global Technologies LLC, Midland, MI (US)

(72) Inventors: Chao Zhao, Shanghai (CN); Xue Chen, Manvel, TX (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/252,557

(22) PCT Filed: Aug. 24, 2021

(86) PCT No.: PCT/CN2021/114209

§ 371 (c)(1),
(2) Date: May 11, 2023

(87) PCT Pub. No.: WO2023/023924

PCT Pub. Date: Mar. 2, 2023

(65) Prior Publication Data

US 2023/0392094 A1 Dec. 7, 2023

(51) Int. Cl.

| | |
|---|---|
| ***C10M 133/06*** | (2006.01) |
| ***C10M 173/00*** | (2006.01) |
| *C10N 30/16* | (2006.01) |
| *C10N 40/22* | (2006.01) |
| *C10N 50/00* | (2006.01) |

(52) U.S. Cl.

CPC ..... *C10M 133/06* (2013.01); *C10M 173/00* (2013.01); *C10M 2203/1065* (2013.01); *C10M 2207/127* (2013.01); *C10M 2209/103* (2013.01); *C10M 2215/042* (2013.01); *C10M 2219/044* (2013.01); *C10N 2030/16* (2013.01); *C10N 2040/22* (2013.01); *C10N 2050/011* (2020.05)

(58) Field of Classification Search

CPC ..... C10N 2040/20; C10N 2050/011; C10N 2050/013; C10M 173/00; C10M 133/06

See application file for complete search history.

(56) References Cited

U.S. PATENT DOCUMENTS

| | | | | |
|---|---|---|---|---|
| 5,132,046 | A | 7/1992 | Edebo et al. | |
| 5,863,874 | A * | 1/1999 | Person Hei | C10M 129/28 508/525 |
| 7,595,288 | B2 * | 9/2009 | Fretz | C10M 173/02 508/156 |
| 8,297,411 | B2 | 10/2012 | Hashimoto et al. | |
| 9,587,197 | B2 | 3/2017 | Duncan et al. | |

(Continued)

FOREIGN PATENT DOCUMENTS

| | | |
|---|---|---|
| CN | 1194665 A | 9/1998 |
| CN | 103343037 A | 10/2013 |

(Continued)

OTHER PUBLICATIONS

PCT/CN2021/114209 International Search Report and Written Opinion with a mailing date of Apr. 26, 2022.

*Primary Examiner* — Vishal V Vasisth

(57) ABSTRACT

A microbial growth control agent and method of controlling microbial growth in metal working fluids, wherein the agent comprises at least a glycol ether amine.

8 Claims, 1 Drawing Sheet

(56) References Cited

U.S. PATENT DOCUMENTS

| | | | | |
|---|---|---|---|---|
| 9,957,458 | B2 | 5/2018 | G. S et al. | |
| 2008/0255215 | A1 | 10/2008 | Gernon et al. | |
| 2010/0093736 | A1* | 4/2010 | Coburn ..... | A01N 43/80<br>507/131 |

FOREIGN PATENT DOCUMENTS

| | | | |
|---|---|---|---|
| CN | 103805330 | A | 5/2014 |
| CN | 105050397 | A | 11/2015 |
| CN | 112638492 | A | 4/2021 |
| JP | 4728157 | B2 | 7/2011 |

* cited by examiner

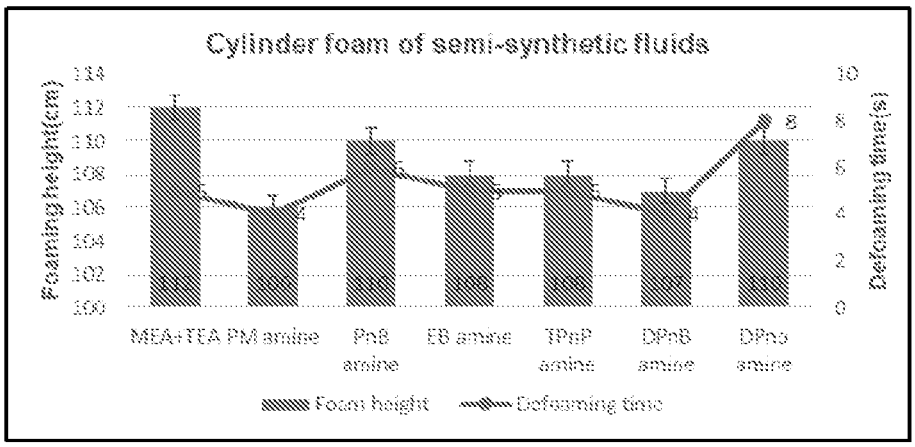
Cylinder foam of semi-synthetic fluids
Foaming height(cm)
114
112
110
108
106
104
102
100
Defoaming time(s)
10
8
6
4
2
0
MEA+TEA PM amine
PnB amine
EB amine
TPnP amine
DPnB amine
DPnp amine
Foam height
Defoaming time

METAL WORKING FLUIDS BIOCIDE

This application is a 371 of PCT/CN2021/114209, filed Aug. 24, 2021.

Embodiments relate to a microbial growth control agent and method of controlling microbial growth in metal working fluids, wherein the agent comprises at least a glycol ether amine.

INTRODUCTION

Metal working fluids (MWFs) are used for lubrication of metal cutting and tool forming. These fluids provide cooling for the metal work tooling, removal of cutting chips from the tool/work piece interface and help provide an acceptable post-machining finished surface. Amines are a popular MWF widely used in a variety of applications due to their properties of anti-corrosion, neutralization, and pH adjustment. Organic amines are usually used as corrosion inhibitors because MWFs are degraded over time due to microbial growth which is negatively impact fluid performance and the microbes feed on the active ingredients in the fluid.

Such microbial growth in the MWFs may cause serious problems in metalworking processing in many forms including: MWFs general souring. MWFs viscosity changing, MWFs shelf life shortening, and the corroding of tools and materials. Additionally, the functioning of equipment and processes such as feeding nozzles, storage tanks, pipelines and recycling system facilities may also be impacted by microbe growth in MWFs. This souring increases the cost of MWFs, accelerates corrosion rates and decreases efficiency of metal processing.

Thus, there is an unfulfilled need in the MWF industry for components which do not support microbial growth and maintain performance over a long time. The most common solution is to add biocides and amine alcohols either continuously or as a batch treatment to a given MWF. However, biocides and some secondary amine alcohols are limited by regulatory restrictions and most of the biocide chemicals will release formaldehyde over time which is hazardous to human health.

For all these reasons and more, there is a need for a microbial growth control agent and method of controlling microbial growth in metal working fluids.

SUMMARY

Embodiments relate to a microbial growth control agent and method of controlling microbial growth in metal working fluids, wherein the agent comprises at least a glycol ether amine.

DETAILED DESCRIPTION

Depending on their composition, metal working fluids are classified as neat oil, soluble oil, semi-synthetic fluid, or synthetic fluid. Soluble oil MWFs comprise 50-70 wt. % oil with the rest being anti-wear/extreme pressure additives and emulsifiers. Semi-synthetic MWF contains a significant amount of water, typically up to 50-60 wt. %, around 10-40 wt. % mineral oil, around 10-20 wt. % emulsifiers, around 10-20 wt. % amine, and other functional additives such as lubricant, corrosion inhibitor, solubilizer, pH neutralizer, biocide etc. Semi-synthetic MWFs are usually diluted with water at an end user's site to a concentration of 1-20 wt. %, more typically 5-7 wt. % concentration. Semi-synthetic fluids have balanced lubricity and cooling performance and are thus attractive for use as MWFs. In the present disclosure, the microbial growth control agent and/or biocide may be used as a pH neutralizer in semi-synthetic fluid or other MWFs.

The presently disclosed microbial growth control agent and/or biocide may be described, in one embodiment, as a glycol ether amine. Suitable glycol ether amines include, but are not limited to: 2-butoxy-ethanamine, 1-methoxy-2-propanamine, 1-butoxy-2-propanamine, 1-[1-methyl-2-(1-methyl-2-propoxyethoxy)ethoxy]-2-propanamine, 1-(2-butoxy-1-methylethoxy)-2-propanamine, 1-(2-methoxy-1-methylethoxy)-2-propanamine and 1-(1-methyl-2-propoxyethoxy)-2-propanamine. It was surpassingly found that such glycol ether amines are good biocides against bacteria and other microbes present in MWFs.

In another embodiment, the presently disclosed biocidal composition may be a composition comprising at least a glycol ether amine, wherein the primary ether amine compound is of the formula below:

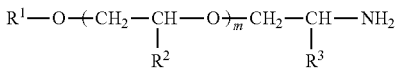

Wherein R1 is a C1-C6 alkyl group, more preferably C3-C4 alkyl group, and R2 and R3 are independently CH3 or CH2-CH3, and m is 0 to 6 (or preferably from 0 to 2).

The concentration of the glycol ether amine in the MWF may range from 0.01 wt % to 30%, more preferably from 5% to 20 wt. % which depends on the intended usage of a given formulation. Most glycol ether amines are liquid but both solid and liquid amines are used in MWF.

The microbial growth control agent may further comprise one or more additional glycol ether amines which may be used in combination achieve a certain microbial growth control target.

The (optional) emulsifier may be anionic, cationic or nonioic. Examples of suitable anionic surfactants or emulsifiers are alkali metal, ammonium and amine soaps; the fatty acid part of such soaps contains preferably at least 10 carbon atoms. The soaps can also be formed "in situ;" in other words, a fatty acid can be added to the oil phase and an alkaline material to the aqueous phase.

Other examples of suitable anionic surfactants or emulsifiers are alkali metal salts of alkyl-aryl sulfonic acids, sodium dialkyl sulfosuccinate, sulfated or sulfonated oils. e.g., sulfated castor oil; sulfonated tallow, and alkali salts of short chain petroleum sulfonic acids.

Suitable cationic surfactants or emulsifiers are salts of long chain primary, secondary or tertiary amines, such as oleylamide acetate, cetylamine acetate, di-dodecylamine lactate, the acetate of aminoethyl-aminoethyl stearamide, dilauroyl triethylene tetramine diacetate, 1-aminoethyl-2-heptadecenyl imidazoline acetate; and quaternary salts, such as cetylpyridinium bromide, hexadecyl ethyl morpholinium chloride, and diethyl di-dodecyl ammonium chloride.

Examples of suitable nonionic surfactants or emulsifiers are condensation products of higher fatty alcohols with ethylene oxide, such as the reaction product of oleyl alcohol with 10 ethylene oxide units; condensation products of alkylphenols with ethylene oxide, such as the reaction product of isoctylphenol with 12 ethylene oxide units; condensation products of higher fatty acid amides with 5, or more, ethylene oxide units; polyethylene glycol esters of long chain fatty acids, such as tetraethylene glycol monopalmitate, hexaethyleneglycol monolaurate, nonaethyleneglycol monostearate, nonacthyleneglycol dioleate, tridecaethylcneglycol monoarachidate, tricosaethyleneglycol monobehenate, tricosaethyleneglycol dibehenate, polyhydric alcohol partial higher fatty acid esters such as sorbitan tristearate, ethylene oxide condensation products of polyhydric alcohol partial higher fatty acid esters, and their inner anhydrides (mannitol-anhydride, called Mannitan, and sorbitol-anhydride, called Sorbitan), such as glycerol monopalmitate reacted with 10 molecules of ethylene oxide, pentaerythritol monooleate reacted with 12 molecules of ethylene oxide, sorbitan monostearate reacted with 10-15 molecules of ethylene oxide, mannitan monopalmitate reacted with 10-15 molecules of ethylene oxide; long chain polyglycols in which one hydroxyl group is esterified with a higher fatty acid and other hydroxyl group is etherified with a low molecular alcohol, such as methoxypolyethylene glycol 550 monostearate (550 meaning the average molecular weight of the polyglycol ether). A combination of two or more of these surfactants may be used; e.g., a cationic may be blended with a nonionic or an anionic with a nonionic.

The microbial growth controlled by the presently disclosed biocide typically consists of contaminations which are a bacterial and fungal mixture. Some typical fungi and bacterial containments include but are not limited to *Aeromonas hydrophila* (ATCC 13444). *Candida albicans* (ATCC 752), *Desulfovibrio desulfuricans* (ATCC 7757). *Escherichia coli* (ATCC 8739), *Flavobacterium ferrugineum* (ATCC 13524), *Fusarium oxysporum* (ATCC 7601), *Klebsiella pneumoniae* (ATCC 13883), *Proteus mirabilis* (ATCC 4675). *Pseudomonas aeruginosa*(ATCC 8689), *Pseudomonas oleovorans* (ATCC 8062) and *Saccharomyces cerevisiae* (ATTC 2338). The strains listed above can vary around the world and the present innovation is fully envisioned as broad-spectrum microbial growth control agent and/or biocide which can be used against any common MWF microbial contaminates.

EXAMPLES

An experiment to test the efficacy of the presently disclosed microbial growth control agent and others may be conducted as follows.

TABLE 1

Diluted Metalworking Fluid Ingredients

| Ingredient | Weight Percentage | Function | Source |
|---|---|---|---|
| Diacid | 0.14 wt. % | Corrosion agent | Yihai Kerry |
| 2-Ethylhexoic Acid | 0.28 wt. % | Solubilizer | Dow |
| UCON ™ Lubricant MWL-4 | 0.47 wt. % | lubricant | Dow |
| Naphthenic oil | 2.0 wt. % | Oily agent | Hengshui Xihao |
| Sodium Alkane Sulfonate | 0.225 wt. % | Emulsifier | Runze Chemical Co., Ltd |
| KAO EMULGEN 107 | 0.65 wt. % | Emulsifier | KAO |

TABLE 1-continued

Diluted Metalworking Fluid Ingredients

| Ingredient | Weight Percentage | Function | Source |
|---|---|---|---|
| Amine | 0.91 wt. % | pH neutralizer | Dow |
| DI water | 95.325 wt. % | Water phase | Dow |

TABLE 2

Ether Amines Tested

| Example | Amine | Product Name |
|---|---|---|
| Comparative Example 1 | MEA + TEA | Monoethanolamine, Triethanolamine |
| Comparative Example 2 | AMP-95 | 2-amino-2-methyl-1-propanol |
| Example 1 | PM amine | 1-methoxy-2-propanamine |
| Example 2 | PnB amine | 1-butoxy-2-propanamine |
| Example 3 | EB amine | 2-butoxy-ethanamine |
| Example 4 | TPnP amine | 1-[1-methyl-2-(1-methyl-2-propoxyethoxy)ethoxy]-2-propanamine |
| Example 5 | DPnB amine | 2-propanamine, 1-(2-butoxy-1-methylethoxy)- |
| Example 6 | DPnP amine | 1-(1-methyl-2-propoxyethoxy)-2-propanamine |

Test 1—Microbial Growth Inhibition Test

To test the novel disclosed microbial growth control agent the diluted metal working fluid shown in Table 1 is mixed with the various ether amines listed in Table 2. Firstly, using 250 mL glass beaker to prepare 100 g the basic diluted metalworking fluid with the recipe in Table 1 except amine ingredient, stirring for getting clear solution. Repeating the first step to get 8 basic diluted metalworking fluid solutions. Secondly, adding every kind of amine or amine combination from Table 2 as comparative example 1-2 and example 1-6. Thirdly, 50 g the comparative example 1-2 and example 1-6 into 8 petri dishes with a diameter of 10 cm and dosed with 0.5 ml of mixed microbial inoculum. Measuring the microbial growth in the petri dishes after 7 days and repeating to dose the mixed microbial inoculum and measuring them in 5 times. For the first and second dosing, 0.5 ml mixed inoculum is used; in third and fourth dosing, 1 ml mixed inoculum is used; and in the fifth dosing, 3 ml mixed inoculum is used The MWF microbial inoculum was prepared by adding 0.1 mL of each bacterial overnight broth culture and 1.0 mL of each yeast broth culture to the 10 mL of mold suspension and blending. The microbial strains used in this experiment are listed in Table 3 below (8 bacteria, 2 molds and 2 fungi). These strains were cultivated separately in nutrient broth and then blend them together. The mixed strains were then injected into each tested MWF and amine sample and mixed well.

TABLE 3

Tested Microbes

| | Microorganisms | ATCC # |
|---|---|---|
| Bacteria: | *Pseudomonas aeruginosa* | 10145 |
| | *Pseudomonas putida* | 12633 |
| | *Enterobacter aerogenes* | 13048 |
| | *Alcaligenes faecalis* | 25094 |
| | *Proteus hauseri* | 13315 |
| | *Burkholderia cepacia* | 21809 |

TABLE 3-continued

| Tested Microbes | | |
|---|---|---|
| | Microorganisms | ATCC # |
| | *Gluconacetobacter liquefaciens*(Asai) | 14835 |
| | *Gluconacetobacter liquefaciens* | 23751 |
| Yeast: | *Saccharomyces cerivisae* | 2338 |
| | *Candida lipolytica* | 18942 |
| Mold: | *Aspergillus niger* | 6275 |
| | *Penicillium ludwigii* | 9112 |

50 grams of each of the MWF treated with amine samples (e.g., Examples 1-5 and Comparative Examples 1-2) were dosed with 0.5 ml of mixed microbial inoculum on Day 0 of this experiment. This inoculation introduces around 106-107 colony forming units per milliliter of sample, (CFU/ml) of microorganisms.

The mixed inoculated samples where then incubated at 30° C. to determine the biocidal effect of the tested amines on the microbes. After seven days, the number of microorganisms surviving in the petri dish was observed and if the colony growth was less than 10, it was considered as PASS. After measuring the number of surviving microorganisms, another round of dosing with the mixed microbial inoculum was complete. The step of observation and subsequent dosing was done 5 times to challenge the microbial growth inhibition capabilities of the tested examples. For the first and second dosing, 0.5 ml mixed inoculum was used; in third and fourth dosing, 1 ml mixed inoculum was used; and in the fifth dosing, 3 ml mixed inoculum is used. The results are recorded below in Table 4.

TABLE 4

| Challenge Test Results | | | | | | |
|---|---|---|---|---|---|---|
| Sample | Amine | 1st dose Day 7 | 2nd dose Day 14 | 3rd dose Day 21 | 4th dose Day 28 | 5th dose Day 35 |
| Comparative Example 1 | MEA + TEA | Pass | Pass | Pass | Fail/mold | Fail/mold |
| Comparative Example 2 | AMP-95 | Pass | Pass | Pass | Pass | Pass |
| Example 1 | PM amine | Pass | Pass | Pass | Pass | Pass |
| Example 2 | PnB amine | Pass | Pass | Pass | Pass | Pass |
| Example 3 | EB amine | Pass | Pass | Pass | Pass | Pass |
| Example 4 | TPnP amine | Pass | Pass | Pass | Pass | Pass |
| Example 5 | DPnB amine | Pass | Pass | Pass | Pass | Pass |
| Example 6 | DPnp amine | Pass | Pass | Pass | Pass | Pass |

As shown above the glycol ether amines (Examples 1-6) have demonstrated better microbial growth inhibition performance than the traditional amines (Comparative Examples 1-2).

The invention claimed is:

1. A metal working fluid composition comprising a microbial growth control agent suitable for metal working fluids, comprising 2-butoxy-ethanamine, or at least one glycol ether amine with the structure of:

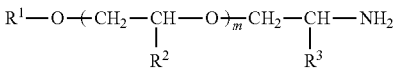

wherein R1 is a C3-C4 alkyl group and R2 is CH3 or CH2-CH3 and R3 is CH3 or CH2-CH3, and m is 0 to 6;

wherein the metal working fluid composition further comprises:

water; mineral oil; and emulsifier; and wherein the glycol ether amine is present in an amount of from 5% to 20% by weight of the metal working fluid.

2. The metal working fluid composition of claim 1, wherein R1 is a C3-C4 alkyl group or m is 0 to 2.

3. The metal working fluid composition of claim 1, wherein the at least one glycol ether amine 1-methoxy-2-propanamine, 1-butoxy-2-propanamine, 1-[1-methyl-2-(1-methyl-2-propoxyethoxy)ethoxy]-2-propanamine'1-(2-butoxy-1-methylethoxy)-2-propanamine, 1-(2-methoxy-1-methylethoxy)-2-propanamine or 1-(1-methyl-2-propoxyethoxy)-2-propanamine.

4. The metal working fluid composition of claim 1, wherein the metal working fluid compositions comprises one or more other functional additives selected from the group consisting of lubricants, corrosion inhibitors, solubilizers, pH neutralizers and biocides.

5. The metal working fluid composition of claim 1, wherein the metal working fluid composition further comprises a second glycol ether amine.

6. A method of controlling microbial growth in metal working fluids by use of from 5 to 20% by weight of a microbial control agent, wherein the microbial control agent comprises one glycol ether amine with the structure of:

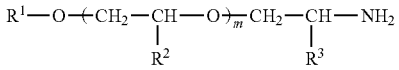

wherein R1 is a C3-C4 alkyl group and R2 is CH3 or CH2-CH3 and R3 is CH3 or CH2-CH3, and m is 0 to 6 wherein the metal working fluids further comprise: water; mineral oil; and emulsifier.

7. The method of claim 6, wherein at least one other glycol ether amine is used.

8. The method of claim 6, wherein the method is used for controlling bacteria, mold, or yeast in metal working fluids.

* * * * *